US010780440B2

(12) United States Patent
Vinchoff et al.

(10) Patent No.: US 10,780,440 B2
(45) Date of Patent: Sep. 22, 2020

(54) ANTI-SPIN APPARATUS AND METHOD FOR CONE CRUSHER HEAD

(71) Applicant: Sepro Mineral Systems Corp., Langley (CA)

(72) Inventors: Mark Henry Vinchoff, Chilliwack (CA); David Hornick, Langley (CA)

(73) Assignee: Sepro Mineral Systems Corp., Langley, BC (CA)

( * ) Notice: Subject to any disclaimer, the term of this patent is extended or adjusted under 35 U.S.C. 154(b) by 184 days.

(21) Appl. No.: 15/766,200

(22) PCT Filed: Nov. 3, 2016

(86) PCT No.: PCT/CA2016/051278

§ 371 (c)(1),
(2) Date: Apr. 5, 2018

(87) PCT Pub. No.: WO2017/075707

PCT Pub. Date: May 11, 2017

(65) Prior Publication Data

US 2018/0280982 A1 Oct. 4, 2018

Related U.S. Application Data

(60) Provisional application No. 62/250,637, filed on Nov. 4, 2015.

(51) Int. Cl.
*B02C 2/04* (2006.01)
*B02C 2/00* (2006.01)

(52) U.S. Cl.
CPC ..... *B02C 2/047* (2013.01); *B02C 2/04* (2013.01); *B02C 2002/002* (2013.01)

(58) Field of Classification Search
CPC ..... B02C 2/047; B02C 2/04; B02C 2/005; B02C 2002/002
See application file for complete search history.

(56) References Cited

U.S. PATENT DOCUMENTS 3,404,833 A 8/1968 Pause
3,887,143 A * 6/1975 Gilbert ..... B02C 2/04 241/215

(Continued)

FOREIGN PATENT DOCUMENTS

CN 1945481 A 10/2008
CN 101641158 A 2/2010
WO 2013/009531 A1 1/2013

OTHER PUBLICATIONS

CN Application No. 2016800621199 received an office action dated Jun. 19, 2019, 2 pages.

(Continued)

*Primary Examiner* — Faye Francis
(74) *Attorney, Agent, or Firm* — Kilpatrick Townsend & Stockton LLP

(57) ABSTRACT

A method and apparatus for counteracting spin of the crusher head on cone or gyratory crushers is provided. An annular rubber muscle element is secured relative to said bowl frame and positioned between the bowl frame and a surface of the head, and which can be selectively placed into contact under pressure with the surface of the head to prevent spin during start up but which is then released during normal crushing operation.

17 Claims, 10 Drawing Sheets

(56) References Cited

U.S. PATENT DOCUMENTS

| | | | | |
|---|---|---|---|---|
| 4,168,036 | A * | 9/1979 | Werginz | B02C 2/047 241/207 |
| 4,192,472 | A | 3/1980 | Johnson | |
| 4,206,881 | A * | 6/1980 | Werginz | B02C 2/047 241/207 |
| 4,232,833 | A * | 11/1980 | Werginz | B02C 2/047 241/207 |
| 5,931,394 | A * | 8/1999 | Haven | B02C 2/047 241/215 |
| 6,299,083 | B1 | 10/2001 | Polinski et al. | |
| 7,931,219 | B2 * | 4/2011 | Eriksson | B02C 2/047 241/207 |
| 2009/0283616 | A1 * | 11/2009 | Eriksson | B02C 2/047 241/25 |
| 2014/0239102 | A1 * | 8/2014 | Dricken | B02C 2/047 241/30 |

OTHER PUBLICATIONS

International Search Report, Written Opinion and International Preliminary Report on Patentability corresponding to PCT/CA2016/051278, dated Nov. 22, 2016, ten pages.

EP168611549 received a Supplementary European Search Report dated Apr. 4, 2019, 7 pages.

* cited by examiner

ANTI-SPIN APPARATUS AND METHOD FOR CONE CRUSHER HEAD

CROSS REFERENCE TO RELATED APPLICATION

The present application claims the benefits, under 35 U.S.C. § 119(e), of U.S. Provisional Application Ser. No. 62/250,637 filed Nov. 4, 2015 entitled "Anti-Spin Apparatus and Method For Cone Crusher Head" which is incorporated herein by this reference.

TECHNICAL FIELD

The invention relates generally to the field of crushers, and more specifically relates to the field of cone or gyratory crushers.

BACKGROUND

Cone or gyratory crushers utilize a gyrating conical crusher head, or cone head, to crush material between the stationary inner conical surface of a bowl liner and the gyrating outer surface of the crusher head's mantle or head liner. The crusher head is given a gyrating motion by a rotating eccentric. When material is being crushed between the crusher head and the bowl liner, the crusher head is largely prevented from rotating relative to the bowl liner. However when no material is in the crushing cavity between the crusher head and the bowl liner, such as at start up, the spinning of the eccentric causes the crusher head also to spin and may reach the same velocity as the eccentric. This causes wear on the mantle and bowl liner when the material to be crushed is then admitted to the crushing cavity, causing an initial severe impact and braking. This also causes some of the material introduced into the crushing cavity to be violently flung from the machine, which again may damage the machine or risk injury to workers.

Prior solutions to this problem included the use of a clutch-based mechanism at the top of the crushing head which suffered from a number of drawbacks. U.S. Pat. No. 6,065,698 discloses the use of fingers at a bottom portion of the crushing gap which engage to prevent spin. U.S. Pat. No. 8,777,143 discloses the use of a braking bush and an annular shoe which engage by centrifugal force during no-load condition to prevent spin. There remains a need therefore for a more effective means for selectively preventing spin of the crusher head during start-up, while releasing the head at other times.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

A more effective arrangement and apparatus for counteracting spin of the crusher head is provided. An annular rubber muscle element held in the bowl frame is positioned between the bowl frame and the surface of the head, preferably the lower surface. The muscle element can be selectively placed into contact under pressure with the head surface to prevent spin during start up and then released during normal crushing operation.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
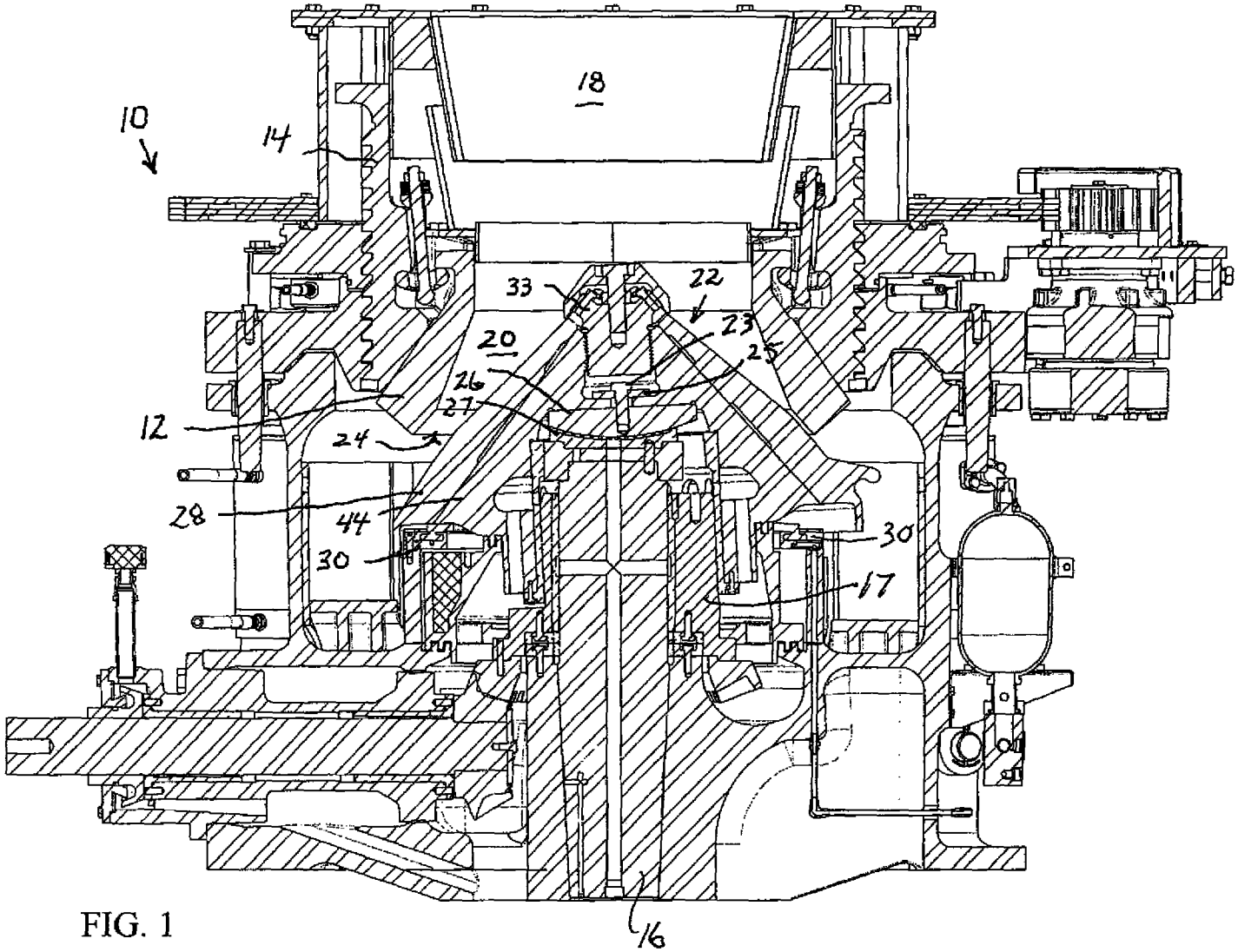
FIG. 1 is a vertical cross-section of a cone crusher according to the invention.

With reference to FIG. 1, cone crusher 10 has a bowl liner 1Z mounted in bowl 14 which has a feed opening 18. Bowl liner 12 has a generally conical interior surface 20. The crusher head assembly 22 extends upwardly into space 24 formed by bowl liner 12. In operation, crusher head assembly 22 gyrates about the central shaft 16 on head ball 26. The crusher head assembly 22 is secured to head ball 26 by a nut 23 and socket washer 25. Head assembly 22 is thereby provided gyratory movement through head ball 26 which rests freely on socket liner 27 and central shaft 16. A film of oil permits head ball 26 to move freely on socket liner 27. Eccentric 17 is motor driven to provide eccentric rotational motion. The crushing surface of crusher head 44 is formed by the mantle 28, referred to herein as the head liner 28, which is typically formed of manganese. Head liner 28 is removably fixed to the frusto-conical surface of head 44 by a compression bolt 33 or the like.

Anti-spin assembly is shown in cross-section at 30 in FIG. 1 and in greater detail in FIG. 2 through 10. Anti-spin assembly comprises a circular base 36, muscle element 34 and outer clamp ring 32. Muscle element 34 is a rubber ring which has a T-shaped lower foot 48 extending downwardly from rubber annulus 50. The anti-spin assembly 30 is secured to bowl frame 40 by bolts 42 which extend through outer clamp ring 32 and base 36 into frame 40. Foot 48 of muscle element 34 is thereby held in the cavity formed between base 36 and clamp ring 32 with rubber annulus 50 sitting above the inner circumference 52 of base 36.

Figure 2:
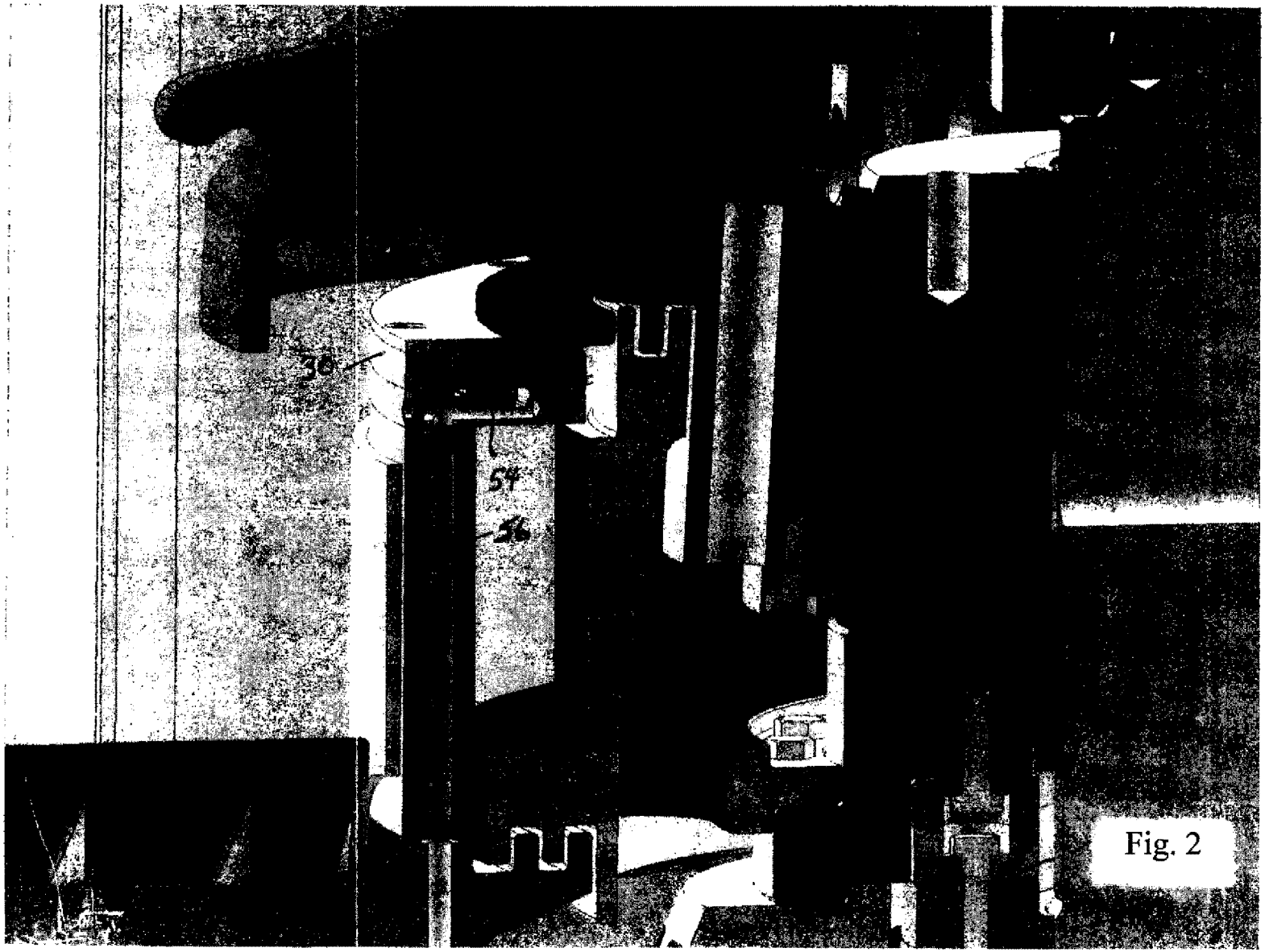
FIG. 2 is a detail of the vertical cross-section of the head assembly of the cone crusher shown in FIG. 1 illustrating in perspective the anti-spin assembly.
Figure 3:
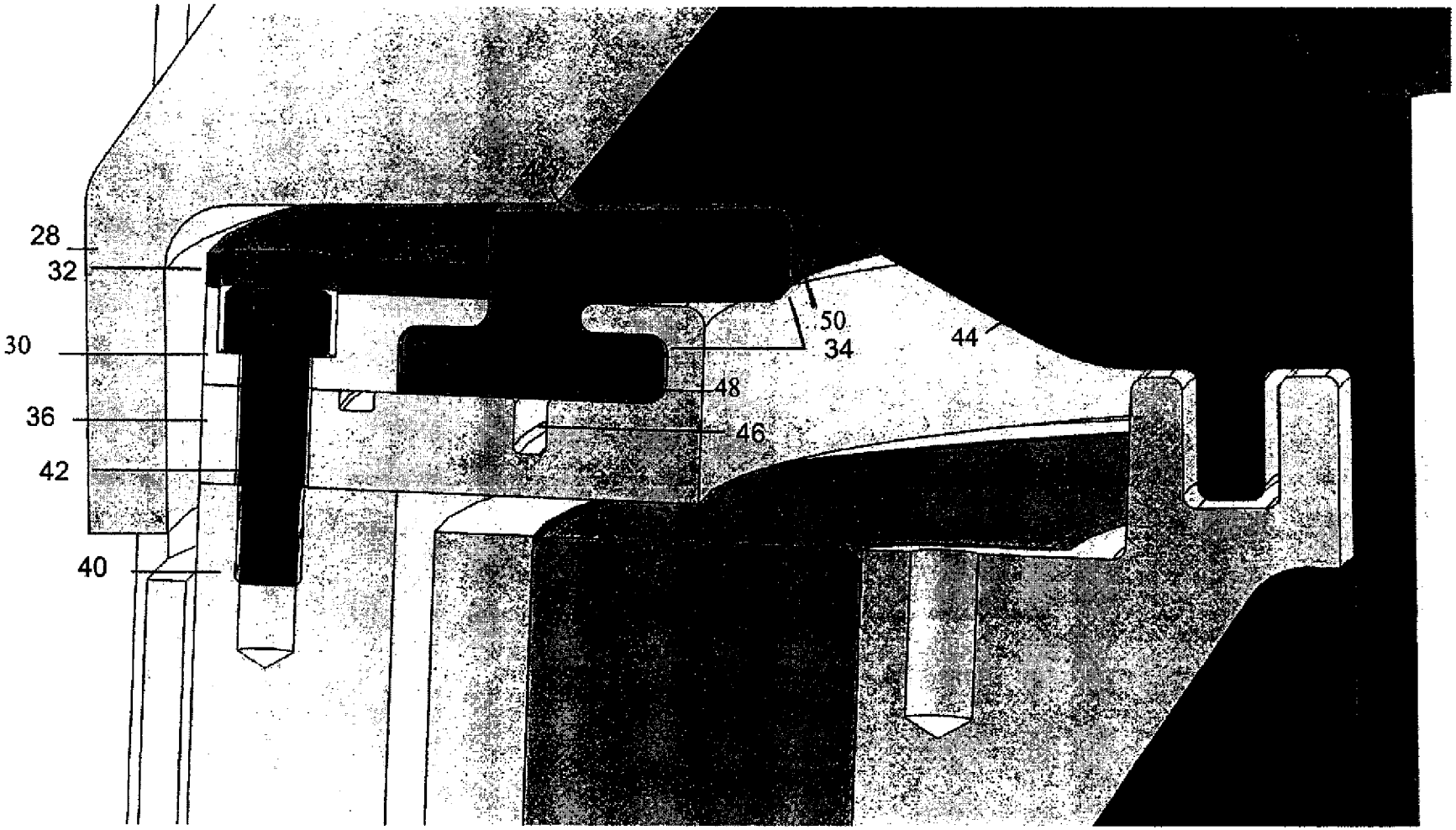
FIGS. 3-5 are detail perspective views partly in cross-section of the anti-spin assembly shown in FIG. 2.

Base 36 is provided with an annular air or liquid manifold 46 which is adjacent the lower surface of foot 48 when the assembly 30 is assembled. Pressurized air or hydraulic fluid is provided to manifold 46 through supply line 56 and channel 54 (FIG. 2).

Figure 4:
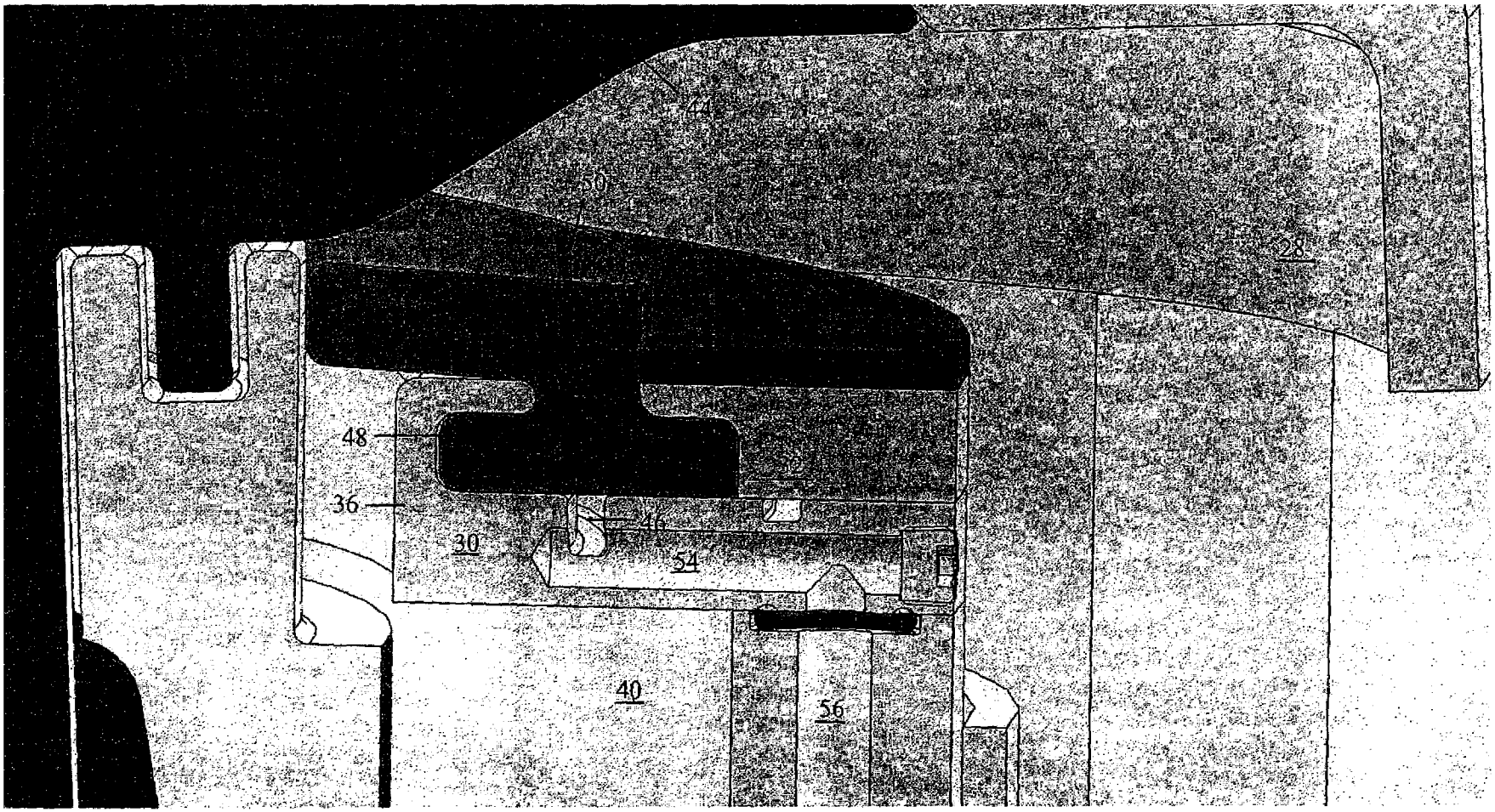
Figure 5:
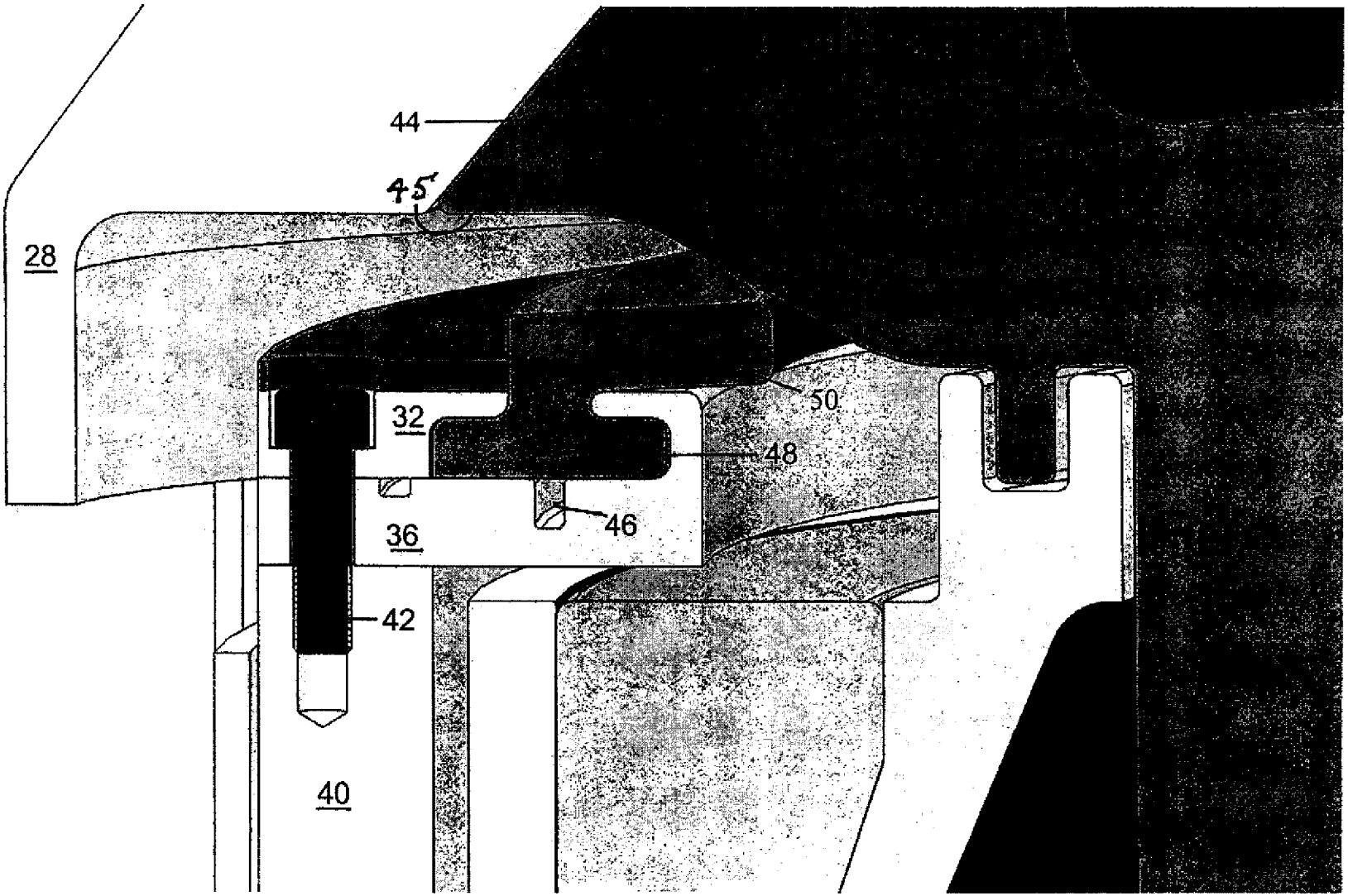
Figure 6:
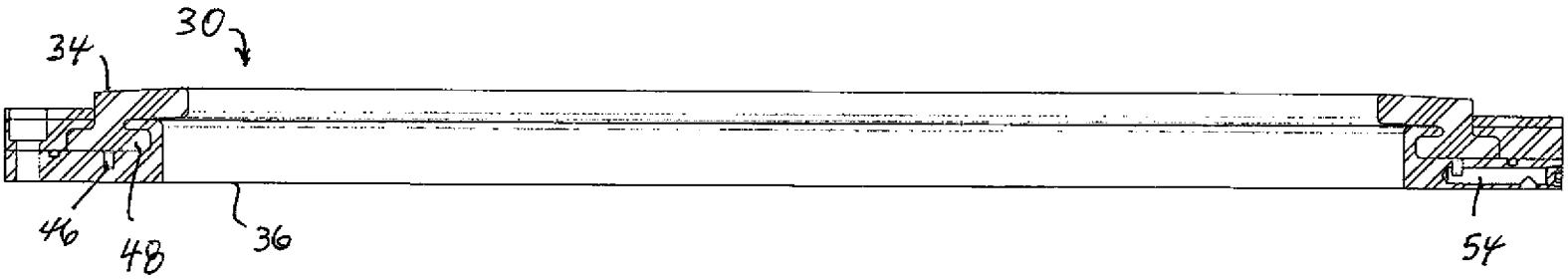
FIG. 6 is an elevation view partly in cross-section of the anti-spin assembly shown in FIG. 2.
Figure 7:
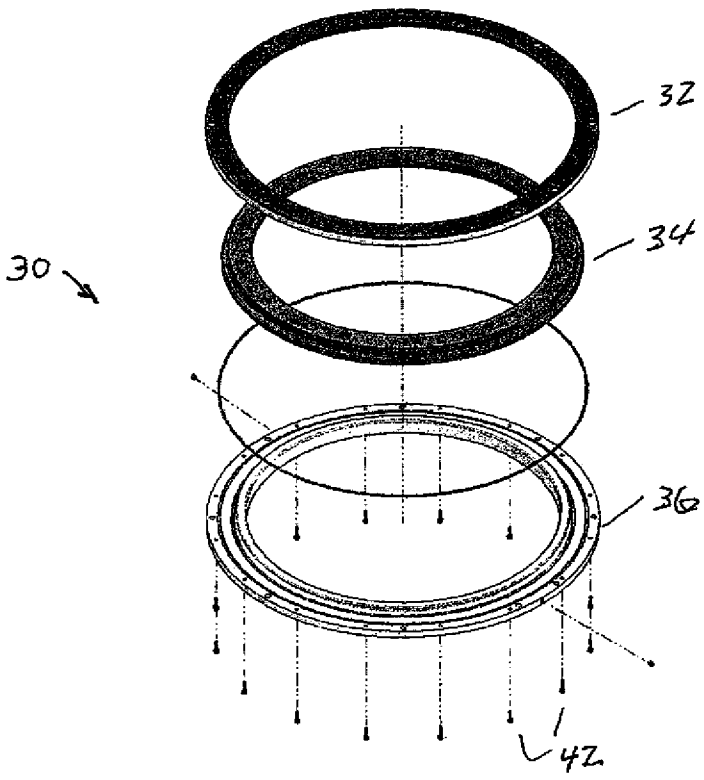
FIG. 7 is an exploded perspective view of the anti-spin assembly shown in FIG. 6.
Figure 8:
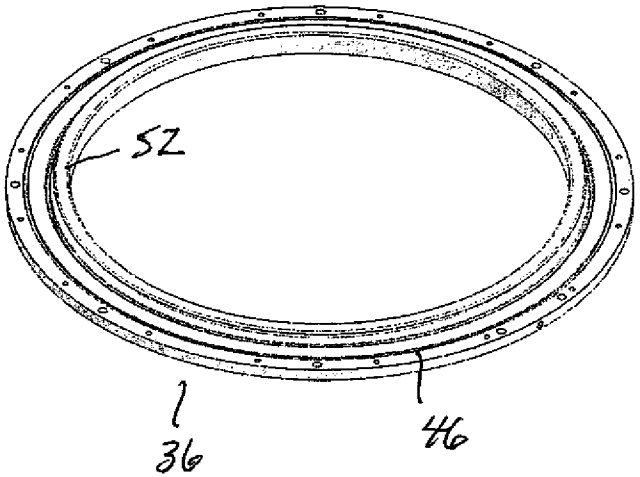
FIG. 8 are an elevation view partly in cross-section, top and bottom perspective views of the base plate for the anti-spin assembly shown in FIG. 6.
Figure 8:
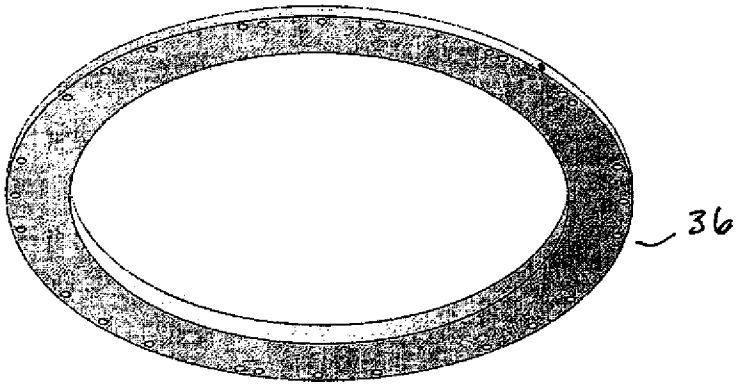
Figure 8:
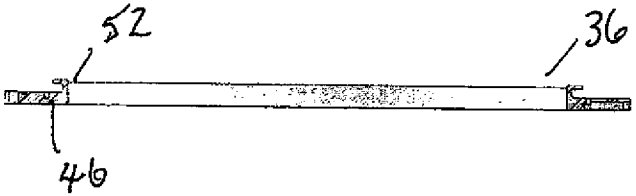
Figure 9:
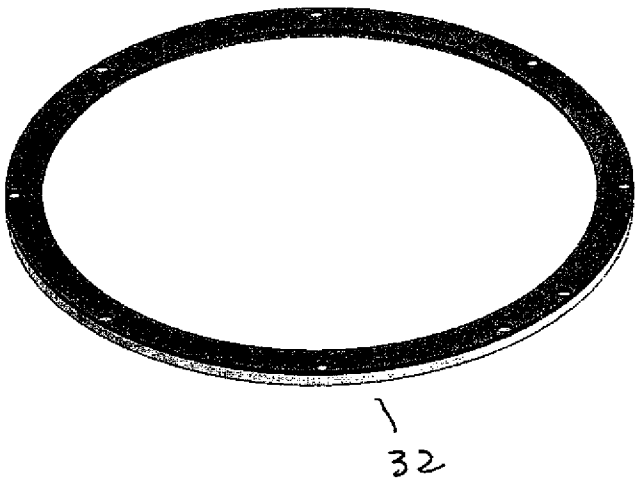
FIG. 9 are an elevation view partly in cross-section, top and bottom perspective views of the outer clamp ring for the anti-spin assembly shown in FIG. 6.
Figure 9:
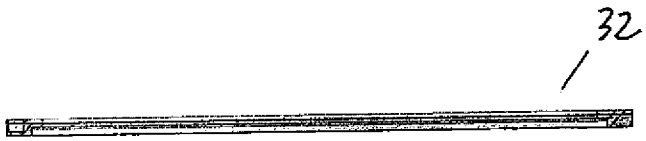
Figure 9:
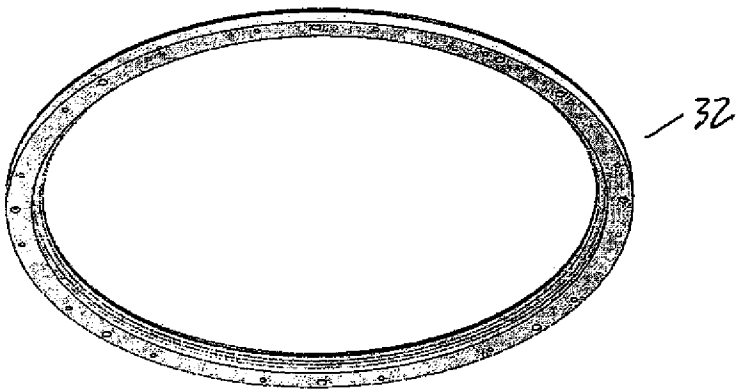
Figure 10:
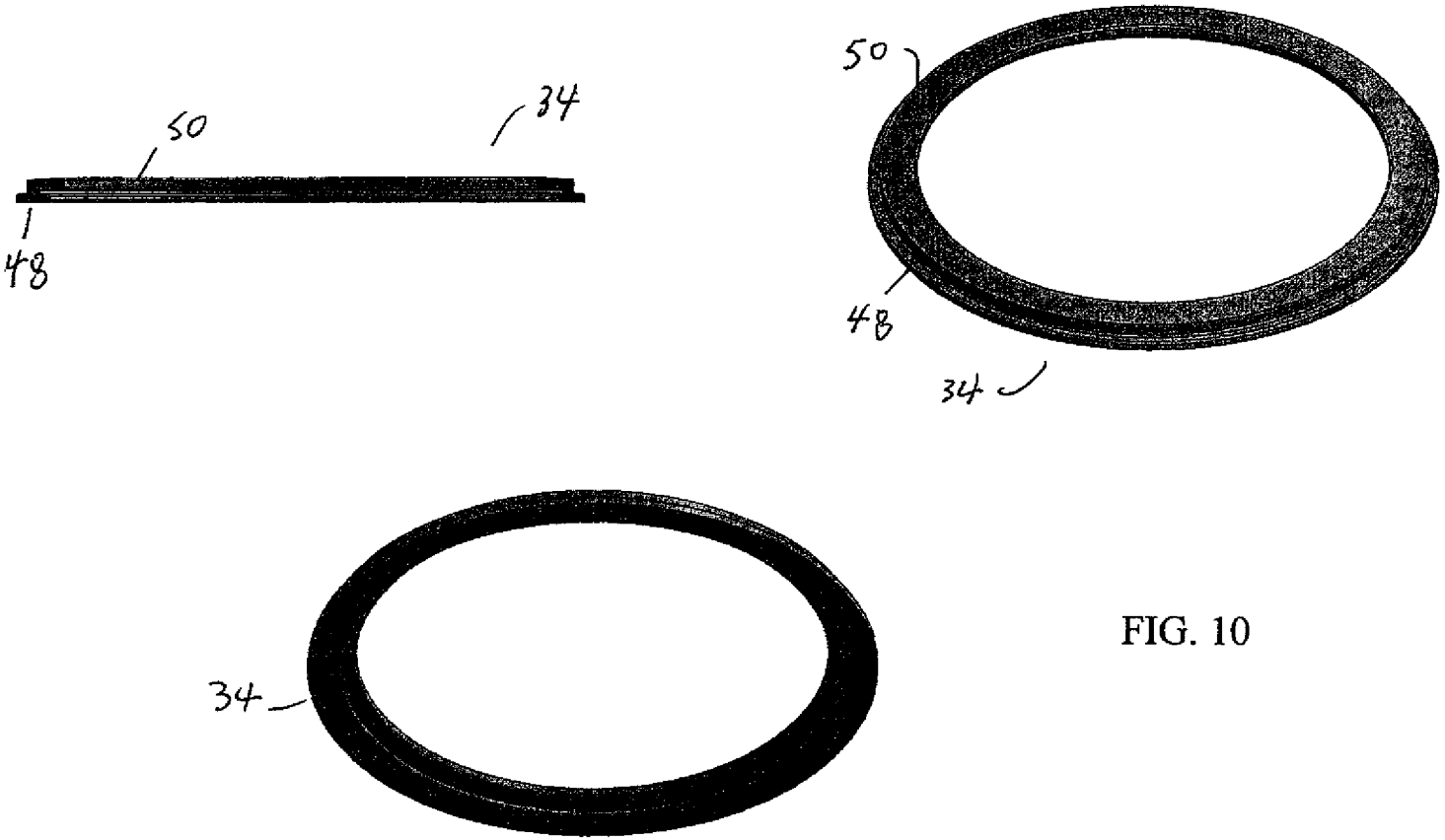
FIG. 10 are an elevation view partly in cross-section, top and bottom perspective views of the outer clamp ring for the anti-spin assembly shown in FIG. 6.

In operation, at start-up, air or liquid under pressure is supplied to manifold 46, which forces muscle element 34 against a surface of head 44, preferably the lower surface 45 of head 44 progressively in those sections where the head 44 is closest to the central shaft 16 (see FIG. 3) while at the opposite side of the central shaft 16 the head 44 is spaced from the muscle element 34 (FIG. 4). The frictional contact between muscle element 34 and the lower surface 45 of head 44 prevents motion of the head relative to the bowl 14. After material for crushing is introduced, the source of pressurized air/liquid to manifold 46 is cut off so that the muscle element 34 no longer contacts the head 44 which is then which is free to move relative to said bowl and is prevented from rotation with the eccentric by the friction of the crushed material between head liner 28 and bowl liner 12.

The crusher head 44 counter-rotates relative to the shaft 16 during crushing operation due to the difference in diameter between the head liner and the bowl liner. The rock which is being crushed acts like a gear, and when that gear is released, then crusher head 44 spins in the same direction as the shaft 16 due to oil friction between the crusher head 44 and the eccentric 17. The anti-spin mechanism can be activated and deactivated by signals from a PLC or other control device based on motor current draw, crusher cavity level sensor or the feed conveyor on/off signal.

While a number of exemplary aspects and embodiments have been discussed above, those of skill in the art will recognize certain modifications, permutations, additions and sub-combinations thereof. It is therefore intended that the invention be interpreted to include all such modifications, permutations, additions and sub-combinations as are within its true spirit and scope.

What is claimed is:

1. A method of counteracting the spin of a crusher head assembly of a cone or gyratory crusher on start-up, the method comprising:

providing a cone or gyratory crusher comprising a bowl liner mounted in a bowl, said bowl having a frame and a feed opening for receiving material to be crushed, said bowl liner having an interior surface, said crusher head assembly extending upwardly into a space formed by said bowl liner, wherein in operation said crusher head assembly gyrates about a central shaft and is provided gyrational motion by a motor-driven rotating eccentric element;

providing a solid deformable annular rubber muscle element positioned between said bowl frame and a surface of the crusher head assembly and having a first external surface selectively spaced from or contacting said surface of said crusher head assembly and a second opposed external surface in communication with a pressurizable manifold;

forcing a portion of said first external surface of said solid deformable annular rubber muscle element against said surface of said crusher head assembly by applying pressure transmitted from said pressurizable manifold to said second opposed external surface of said muscle element to thereby force said portion of said first external surface of said solid deformable annular rubber muscle element against said surface of said crusher head assembly to prevent spin of the crusher head assembly during start-up; and releasing said first external surface of said solid deformable annular rubber muscle element from contact under pressure with said surface of the crusher head assembly during normal operation after material to be crushed has been introduced into said bowl.

2. The method of claim 1 wherein said surface of said crusher head assembly is a downwardly facing surface.

3. The method of claim 1 wherein pressure is provided to said pressurizable manifold by air or liquid under pressure.

4. The method of claim 3 wherein said air or liquid under pressure is supplied from a source of air or liquid under pressure to said pressurizable manifold.

5. The method of claim 4 wherein said air or liquid under pressure is supplied from said source of air or liquid under pressure to said pressurizable manifold which is in communication with said second opposed external surface of said solid deformable annular rubber muscle element to force said first external surface of said solid deformable annular rubber muscle element against a downwardly facing surface of said crusher head assembly in one or more sections of said crusher head assembly where the crusher head assembly is closest to said central shaft.

6. The method of claim 5 wherein at said start-up of said crusher, frictional contact between said first external surface of said solid deformable annular rubber muscle element and said downwardly facing surface of said crusher head assembly in the one or more sections of said crusher head assembly where the crusher head assembly is closest to said central shaft prevents motion of the crusher head assembly relative to the bowl.

7. The method of claim 6 wherein after material to be crushed is introduced into said bowl, the pressure in said pressurizable manifold is reduced, whereby said first external surface of said solid deformable annular rubber muscle element no longer is forced against said downwardly facing surface of said crusher head assembly in the one or more sections of said crusher head assembly where the crusher head assembly is closest to said central shaft, and whereby said crusher head assembly is prevented from rotation with the eccentric element due to friction of the crushed material between said crusher head assembly and said bowl liner.

8. The method of claim 1 wherein said step of forcing a portion of said first external surface of said solid deformable annular rubber muscle element against said surface of said crusher head assembly is controlled by a control device which receives a signal representing motor current draw, or a crusher cavity level sensor, or a feed conveyor on/off signal.

9. In a cone or gyratory crusher, wherein said crusher comprises a bowl liner mounted in a bowl, said bowl having a frame and a feed opening for receiving material to be crushed, said bowl liner having an interior surface, and a crusher head assembly extending upwardly into a space formed by said bowl liner, wherein in operation said crusher head assembly gyrates about a central shaft and is provided gyrational motion by a motor-driven rotating eccentric element, the improvement comprising:

a solid deformable annular rubber muscle element secured relative to said bowl frame and positioned between said bowl frame and a surface of the crusher head assembly;

means for applying pressure to a first external surface of said solid deformable annular rubber muscle element to thereby force a second opposed external surface of said solid deformable annular rubber muscle element into contact under pressure with said surface of the crusher head assembly to prevent spin of the crusher head assembly during start-up, and for releasing reducing the applied pressure to the first external surface of said solid deformable annular rubber muscle element to thereby release said second opposed external surface of said solid deformable annular rubber muscle element from contact under pressure with said surface of the crusher head assembly during normal operation, whereby said means prevents said crusher head assembly from spinning during start-up of said crusher, and, after material for crushing is introduced into said bowl, said second opposed external surface of said solid deformable annular rubber muscle element no longer contacts said surface of said crusher head assembly whereby said crusher head assembly is then prevented from rotation with the eccentric element by the friction of the material for crushing between said crusher head assembly and said bowl liner.

10. The improvement of claim 9 wherein said pressure is provided by air or liquid under pressure.

11. The improvement of claim 10 wherein said air or liquid under pressure is supplied from a source of air or liquid under pressure to a manifold which provides contact of said air or liquid under pressure with the first external surface of said solid deformable annular rubber muscle element to force said second opposed external surface of said solid deformable annular rubber muscle element against said surface of said crusher head assembly.

12. An anti-spin device for a cone or gyratory crusher, wherein said crusher comprises a bowl liner mounted in a bowl, said bowl having a frame and a feed opening for receiving material to be crushed, said bowl liner having an interior surface, and a crusher head assembly extending upwardly into a space formed by said bowl liner, wherein in operation said crusher head assembly gyrates about a central shaft and is provided gyrational motion by a motor-driven rotating eccentric element, said anti-spin device comprising:

a solid deformable annular rubber muscle element secured relative to said bowl frame and positioned between said bowl frame and a surface of the crusher head assembly;

means for applying pressure to a first external surface of said solid deformable annular rubber muscle element to thereby force a second opposed external surface of said solid deformable annular rubber muscle element into contact under pressure with said surface of the crusher head assembly to prevent spin of the crusher head assembly during start up, and for reducing the applied pressure to the first external surface of said solid deformable annular rubber muscle element to thereby release said second opposed external surface of said solid deformable annular rubber muscle element from contact under pressure with said surface of the crusher head assembly during normal operation, whereby said means prevents said crusher head assembly from spinning during start-up of said crusher and, after the crusher has started and material for crushing is introduced into said bowl, the second opposed external surface of said solid deformable annular rubber muscle element no longer contacts said surface of said crusher head assembly whereby said crusher head assembly is then prevented from rotation with the eccentric element by the friction of the crushed material between said crusher head assembly and said bowl liner.

13. The anti-spin device of claim 12 wherein said pressure is provided by air or liquid under pressure.

14. The anti-spin device of claim 13 wherein said air or liquid under pressure is supplied from a source of air or liquid under pressure to a manifold which provides contact of said air or liquid under pressure with the first external surface of said solid deformable annular rubber muscle element to force said second opposed external surface of said solid deformable annular rubber muscle element against said surface of said crusher head assembly.

15. The anti-spin device of claim 13 wherein said air or liquid under pressure is supplied from a source of air or liquid under pressure to a manifold which contacts the first external surface of said solid deformable annular rubber muscle element to force said second opposed external surface of said solid deformable annular rubber muscle element against a downwardly facing surface of said crusher head assembly in one or more sections of said crusher head assembly where the crusher head assembly is closest to said central shaft.

16. The anti-spin device of claim 12 wherein said surface of said crusher head assembly is a downwardly facing surface.

17. The anti-spin device of claim 12 wherein said means is activated and deactivated by signals from a control device based on motor current draw, a crusher cavity level sensor or a feed conveyor on/off signal.

* * * * *